United States Patent [19]

Leemann-Dittmann

[11] 4,110,922

[45] Sep. 5, 1978

[54] APPARATUS FOR THE DISPLAY OF INFORMATION

[76] Inventor: Ruth Leemann-Dittmann, Casa Martina, 7017 Flims-Dorf, Switzerland

[21] Appl. No.: 772,256

[22] Filed: Feb. 25, 1977

[30] Foreign Application Priority Data

Feb. 27, 1976 [CH] Switzerland ..... 2469/76

[51] Int. Cl.[2] ..... G09F 11/15; G09F 11/26

[52] U.S. Cl. ..... 40/447; 40/472; 340/324 R; 340/334

[58] Field of Search ..... 40/28 C, 30, 31, 32, 40/41, 42, 78.11, 96, 125 E, 125 K, 130 E; 340/324 R, 334, 336, 378; 178/17.5

[56] References Cited

U.S. PATENT DOCUMENTS

| | | | |
|---|---|---|---|
| 3,374,565 | 3/1968 | Woolfolk | 40/96 X |
| 3,605,302 | 9/1971 | Müller | 40/32 |
| 3,659,366 | 5/1972 | Woolfolk | 40/28 C |
| 3,813,673 | 5/1974 | Holloman | 40/28 C X |

*Primary Examiner*—John F. Pitrelli
*Assistant Examiner*—G. Lee Skillington
*Attorney, Agent, or Firm*—Larson, Taylor and Hinds

[57] ABSTRACT

Apparatus for the display of information comprises an endless band carrying transverse holders each of which carries a plurality of laminae having differently colored front and rear regions. Each lamina may be positioned either to overlap the front region of the succeeding adjacent lamina or to lie behind it so as respectively to obscure or expose this front region. Selection of one or other of these positions of the laminae is secured by passing the band around a pulley of sufficiently small radius so as to spread the holders apart sufficiently for each lamina to be clear of the succeeding lamina and then moving the lamina to one or other position. The laminae may be magnetic and drawn away from the holder by magnets adjacent this pulley into the overlap position. Alternatively the laminae may be driven back against the holder from the overlap position by jets of air. Letters, numerals or other signs may be built up by selective overlapping of the lamina and the information may be displayed statically behind or move across a window as desired. The information may be cleared from the band by passage of the band around a pulley of larger diameter.

8 Claims, 4 Drawing Figures

APPARATUS FOR THE DISPLAY OF INFORMATION

BACKGROUND OF THE INVENTION

The invention relates to apparatus for the display of information, comprising at least one endless motor driven draw member guided around at least two pulleys which reverse the direction of movement of the draw member, hereinafter termed reversing pulleys, arranged for movement behind a window.

DESCRIPTION OF THE PRIOR ART

Display apparatus is known, for example on public transport means, in which an inscribed belt can be moved behind a window until the name of the destination appears in the window. When the destination is changed the inscribed belt is correspondingly moved further until the new destination becomes visible in the window.

It was proposed in Swiss Pat. No. 460,592, to provide in place of a belt a plurality of inscribed panels pivotably mounted about one of their longitudinal edges on two carriers. By rotation of the carrier, the inscribed panels can be hinged from an upper display position into a lower display position, so that both the front and the back of the panel are usable for the display of information. In the region of the upper longitudinal edge of the panel situated in the upper display position a stop is provided which prevents the panel concerned from turning unintendedly into the lower display position. By rotation of the two carriers about an angle which depends upon the number of panels pivotably arranged on the periphery of the carrier, the panel situated in the upper initial position is lowered so that the stop becomes effective and renders possible the turning over of this panel into the lower display position. The two carriers can also be rotated through a multiple of the above-mentioned angle so that the information recorded on any desired pair of display panels can be brought to the display position.

These known apparatuses to some extent fulfil their purpose well, but they have the disadvantage that they can display only information which was previously recorded on the belt of the panels.

Apparatus for the display of any desired information is known, for example in electronic computers, which comprises a number of digital display elements having at least seven segments, each segment having a luminous diode or a liquid crystal. This kind of display device is suitable only for small display panels which can be read from a distance of at most one metre.

For the display of what is commonly referred to as traveling messages on a large scale format, apparatus is known comprising a plurality of lamps arranged in lines and columns. By means of a complicated control circuit individual lamps may be switched off and on so that inscriptions light up on the display area. This apparatus has the advantage that only desired information can be made visible with it, but it possesses the disadvantages that current consumption is very great, especially in the case of bright ambient lighting, and that maintenance is expensive.

SUMMARY OF THE INVENTION

It is an object of the present invention to provide an apparatus of the initially stated kind which does not possess the above-mentioned disadvantages and which is simple in assembly and can be produced in a rational manner.

The invention provides apparatus for the display of information comprising at least one endless motor driven draw member guided around at least two reversing pulleys in which a plurality of outwardly protruding holders are carried by the draw member and extend transversely of the longitudinal direction thereof; a number of laminae are arranged on each holder each with free ends protruding beyond the holder; the length of each lamina is greater than the distance between two adjacent holders to maintain an overlap zone of adjacent laminae in the extended zone of the draw member; the radius of one reversing pulley is sufficiently small that said overlap is eliminated as said lamina passes round this reversing pulley; means for influencing the position of the free ends of the laminae are provided near the end of the reversal of the draw member by said reversing pulley so that the free end of each lamina after reversal of the draw member is directed by the control of the said means either in front of or behind the overlap region of an adjacent lamina, and the forward region of each lamina is differentiated from the rear region of each lamina in a manner to achieve the display.

BRIEF DESCRIPTION OF THE DRAWINGS

Other parts of the invention are embodied in the preferred form in greater detail which will now be described by way of example with reference to the accompanying drawings in which.

DETAILED DESCRIPTION OF THE INVENTION

Figure 1:
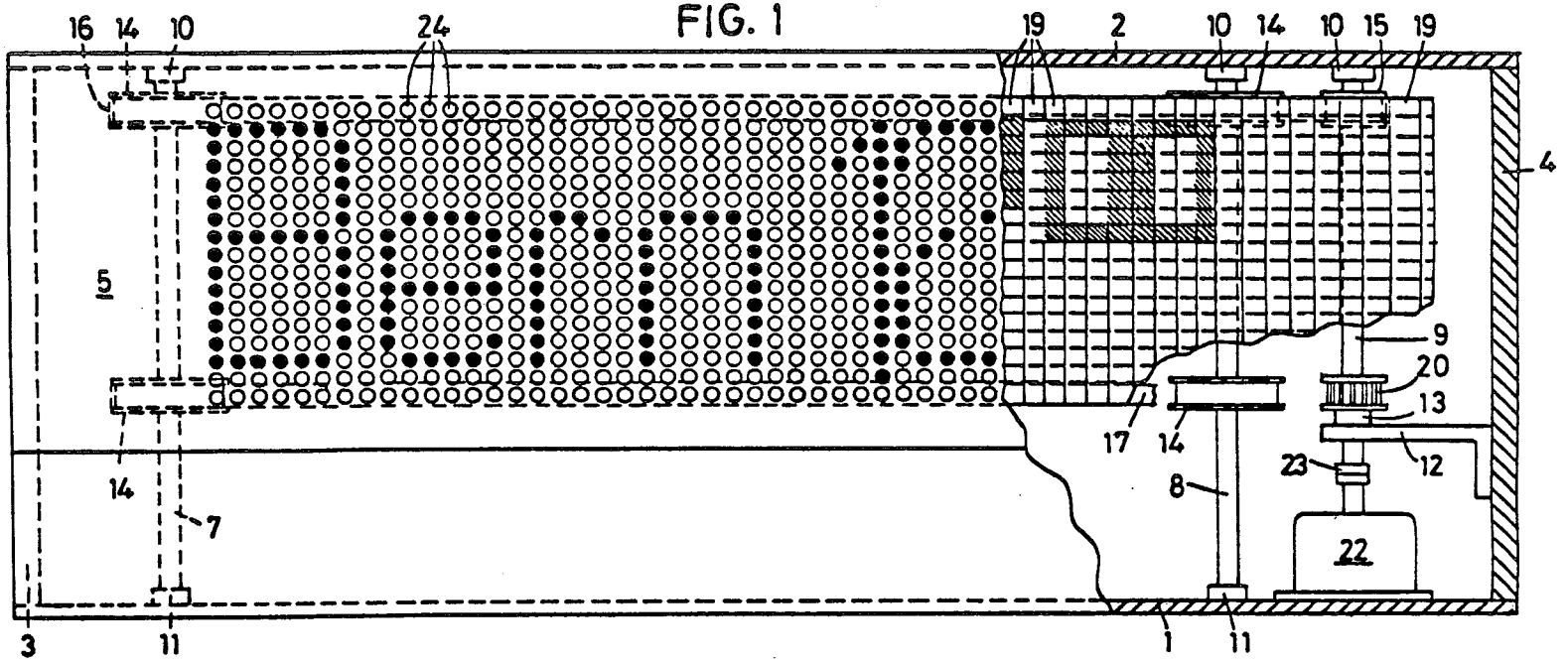
FIG. 1 is an elevation of one form of apparatus according to the invention, a part of the front wall being broken away.
Figure 2:
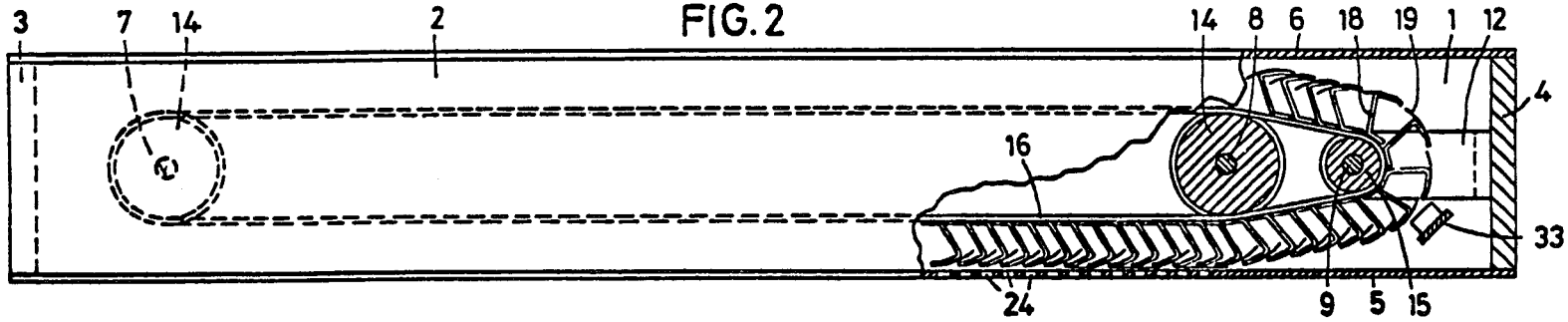
FIG. 2 is a plan view of the form shown in FIG. 1, part of the top wall being broken away.

The apparatus shown in FIGS. 1 and 2 for the display of any desired information represented for example by alphabetic characters or numerals comprises a bottom plate 1 and a top plate 2, spaced apart by side walls 3 and 4. The front of the apparatus is covered by a front plate 5 and the back by a rear wall 6. Between the bottom plate 1 and the top plate 2, there extend three shafts 7, 8 and 9. One end of each shaft is rotatably mounted in a bearing 10 mounted on the top wall 2. The other end of shafts 7 and 8 are rotatably mounted in bearings 11 mounted on the bottom plate and the other end of shaft 9 is rotatably mounted in a bearing 13 secured on a bracket 12. On each of the shafts 7, 8 and 9 there are arranged two guide pulleys 14, over which there are guided two endless flexible draw members 16 and 17 which also pass around driving pulleys 15 on the shaft 9. Only the lower draw member 17 is visible in FIG. 1 and only the upper draw member 16 in FIG. 2.

On the draw members 16 and 17 are arranged a number of holders 18 secured in a manner described in greater detail below with reference to FIG. 5. The holders 18 extend transversely of the direction of movement of the draw members 16 and 17 and each carries a number of laminae 19 for example, as shown in FIGS. 1 and 2, 17 laminae. The forward ends of the laminae 19 are secured to the holder 18 and the laminae 19 extend in the direction opposite to the direction of advance of the draw members 16 and 17. The length of each lamina 19 is greater than the distance between two adjacent holders 18.

Figure 4:
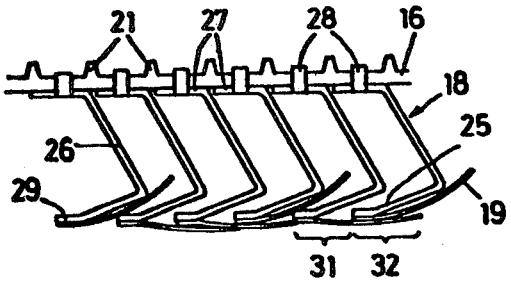
FIG. 4 is a plan of the part shown in FIG. 3.
Figure 5:
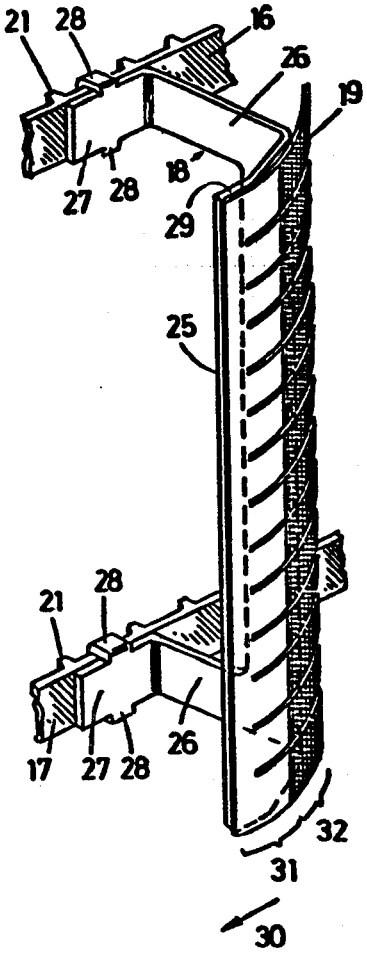
FIG. 5 is a perspective view of a holder carrying a number of laminae forming one column.

The reversing pulleys 15 on the shaft 9 are provided with teeth 20 which mesh with transverse ribs 21 on the inside of the draw members 16 and 17, see FIGS. 4 and 5. Thus a slip-free drive of the draw members 16 and 17 is achieved, a motor 22 driving the shaft 9 through a coupling 23, so that the shaft 9 rotates in the clockwise direction as seen in FIG. 2. This has the effect that the laiminae 19 are moved behind a window in the front plate, which window is formed by a plurality of preferably round openings 24 arranged in lines and columns. The intervals between adjacent openings 24 are preferably equal to the distance between two adjacent holders 18 which is the same as the distance between the centre lines of two adjacent laminae 19.

FIG. 5 shows one of the holders 18, which is shown as having fourteen laminae 19, in perspective representation. The holder comprises a middle part 25 extending from the one draw member 16 to the other draw member 17, the cross-section of which part is made angular to increase the mechanical strength. The ends of the middle part 25 are rigidly connected to a clamp member 27 by struts 26. The clamp member 27 abuts on the outside of the draw member 16 and 17 and has lugs 28 on opposite sides which grasp round the draw member 16 or 17 and connect the middle part 25 of the clamp member with the corresponding draw member. The bent over ends of the lugs 28 are arranged midway between adjacent ribs 21 of the draw members, where they do not interfere with the pulleys 14 and 15.

The middle part 25 of each holder 18 has a zone 29 which is parallel to the clamp member 27 and extends parallel to the draw members when they are in the longitudinally extending condition. The laminae 19 are secured to the middle part 25 in the zone 29 and extend rearwardly in the direction opposite to the direction of movement of the holder 18 indicated by the arrow 30. The laminae 19 consist of a resilient material, preferably soft-magnetic steel, and are initially stressed and slightly curved so that without external force their free ends point towards the draw members 16 and 17. The free end regions of the laminae 19 then rest on the apex of the angular middle part 25 of the holder 18.

The individual holders 18, as may be seen from FIG. 4, are arranged in close succession along the draw members 16 and 17 so that the free end region of each lamina 19 is either situated between the middle part 25 of the next succeeding holder 18 and the draw members or rests on the outside of the following lamina 19. The forward region 31 of the lamina 19, which is visible from the front if it is not covered by the preceding lamina 19, is coloured differently from the rear region 32 of the lamina 19 which is visible from the front only when this region lies on the subsequent lamina 19. In the example described, the forward regions 31 of the laminae are coloured white and the rear regions 32 black. Accordingly, if the rear regions 32 of all laminae 19 are situated between the middle piece 25 of the next following holder 18 and the draw members, the displayed surface would be completely white, and if the rear regions 32 of all laminae 19 lie on the next following laminae the displayed surface would be completely black.

Each two adjacent laminae 19 in the direction of movement according to the arrow 30 constitute a bistable element which changes colour according to whether the rear region 32 of the leading lamina rests on the forward region 31 of the following lamina or not. If for example the rear regions 32 of all the laminae on one holder 18 lie on the forward regions 31 of the laminae 19 on the following holder, then there appears a black bar extending transversely of the direction of advance of the draw members, see FIG. 3. In this way letters, digits or signs can be made visible, in that the rear regions 32 of the laminae either rest on the following lamina 19 or are situated beneath the middle part 25 of the following holder 18. To each letter, digit or sign according to width a number of columns of laminae is allocated. By way of example for the digit 1, three columns are sufficient, while seven columns are necessary for the letter B, as may be seen from FIG. 1.

Figure 3:
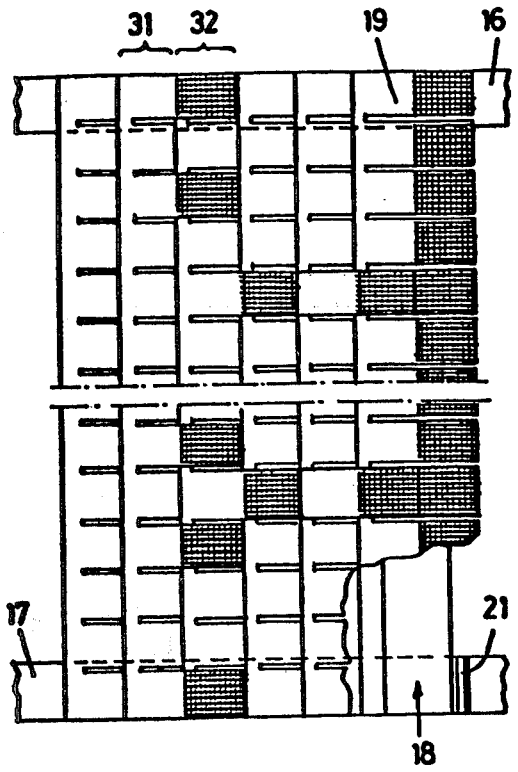
FIG. 3 is a detail of the information-determining part of the apparatus according to FIG. 1 in elevation.

It will now be described with reference to FIG. 3 how the free ends of the laminae 19 come with their rear regions 32 into one of the above-mentioned bistable positions. As stated above, the shaft 9 with the reversing pulleys 15 provided with the teeth 20 is driven in the clockwise direction as viewed from above. The upper run in FIG. 2 of the endless draw members 16 and 17 with the holders 18 is moved from left to right and guided around the reversing pulley 15. Because only the middle zones of the clamping members 27 are secured by the lugs 28 to the draw members 16 and 17, the clamping members 27 extend tangentially of the practically semicircular arc of the draw members in the region of the reversing pulley 15. If for example the radius of the said arc is smaller than the distance between the clamping member 27 and the zone 29 of the middle part 25 of the holder 18 extending parallel therewith, then the distance between the adjacent middle parts 25 of those holders 18 situated in the region of the reversing pulley 15 is more than twice as great as the corresponding distance between adjacent holders 18 situated in the extended zone of the draw members 16 and 17. This has the effect that the laminae 19 initially stressed in the direction towards the draw members and whose free ends previously lay on the forward region 31 of the following lamina slip away from the following lamina by the spreading apart of the middle parts 25, and snap in the direction towards the draw members, resting on the apex of the angular middle part 25. Those laminae which previously rested on the said apex remain in this position. In other words, the information stored by the laminae 19 before reaching the reversing pulleys 15 is cleared at the beginning of movement around the reversing pulley 15, since the free ends of all laminae 19 are returned into one of the two bistable positions. For the information to be thus cleared it is necessary for the length of the laminae 19, the height of the holders 18 (that is the distance between the clamping member 27 and the region 29 of the middle part 25 extending parallel therewith) and the radius of the reversing pulleys 15 to be correctly related to one another.

For recording information in the above-described apparatus, an electromagnet 33 is associated with each line of laminae 19, in FIG. 2 only one magnet namely the uppermost, is visible. In FIG. 1 these electromagnets are not illustrated, for greater clarity. The electromagnet or magnets 33 are arranged at a position immediately before the point at which the draw members leave the reversing pulleys 15. If the electromagnet 33 is not energised during the passage of the lamina 19, the lamina remains in the position illustrated in FIG. 2. If however the electromagnet 33 is energised, the free end of the lamina 19 is attracted by the electromagnet 33 so that in the further movement the forward region of the following lamina 19 in its passage from the arcuate path to the extended path, comes beneath the free end of the preceding lamina. This free end after leaving the field of the electromagnet 33 or after switching off of the electromagnet, lies on the forward region 31 of the following lamina 19. If for example all the electromagnets 33 are briefly energised during the passage of one column of laminae 19, then a black bar extending transversely of the direction of movement of the draw members appears on the display area.

The motor 22 which drives the shaft 9 is preferably a stepping motor which at each step turns the reversing pulleys 15 further by one tooth 20, one of the columns of holders 18 being conducted past the electromagnet 33 each time. Selective energisation of the electromagnets 33 takes place preferably simultaneously with the impulse which steps the stepping motor further. In this way the introduced script characters travel step by step from right to left in the apparatus as illustrated in FIG. 1, these characters becoming visible through the openings 24 in the front plate 5.

The radius of the reversing pulleys 14 is greater than the radius of the pulleys 15, thus the middle parts 25 of the holers 18 are spread apart less during the reversal by the reversing pulleys 14, so that any free ends of preceding laminae resting on the forward region 31 of the following laminae 19 cannot slip away, that is, the introduced information is not cleared in the reversal by the reversing pulleys 14. This renders it possible for the information to be made visible from the back of the apparatus as well, if the back wall 6 is likewise provided with openings 24.

The storage capacity of the apparatus can be increased almost at will, by increasing the distance between the shaft 7 and the shaft 8. No limits are set by the design to the size of the characters for display. The area per character can be selected for example between 6 mm × 10 mm and 60 cm × 100 cm or even larger. The introduced information, can be displayed as long as desired without consumption of energy, if the motor 22 is switched off after the introduction of the information. On the other hand any desired information which can be expressed by letters and numbers can be displayed.

According to the height of the characters to be displayed, it is expedient to use a single draw member or more than two draw members, which naturally affects the number of the reversing pulleys as well. The draw member consists preferably of synthetic plastics material, and the feet of the holders 18, which correspond to the clamp pieces 27, can be integrated in the draw member.

In place of the plurality of openings 24, a single aperture may be provided. This is especially advantageous if the number of laminae 19 arranged in lines and columns is great per script character, so that a fine resolution of the representation of the characters is rendered possible, and if a motor rotating at constant speed is used for the drive of the draw members, so that the written image travels constantly slowly across the window. In this case, it is necessary to provide means (not shown) to control the energisation of the electromagnets in synchronism with the forward movement of the draw member. These means may for example comprise a disc (not shown) with holes fitted on the shaft 9 and a light barrier which generates an impulse every time when a holder 18 is moved past the electromagnets 33.

It is also possible to use laminae of nonmagnetic material which are initially stressed in the direction away from the draw members and of which the free ends, in the absence of external action upon the laminae, cover the forward region 31 of the following lamina. In the reversal by the reversing pulley 15, all the laminae come into this position. Then in place of the electromagnets a corresponding number of nozzles is provided through which an air current is directed at the correct moment upon the lamina in order to press it against the draw member until the forward region of the following lamina has slid over the rear region of the preceding lamina.

Since the present invention is limited only to the mechanical apparatus for the display of information, detailed description of the electric equipment which controls the selective energisation of the electromagnets or the actuation of the air currents in synchronism with the speed of advance of the draw members will be omitted. It need merely be mentioned that this equipment may comprise known code converters such as for example convert the code of a teleprinter into the code necessary for the operation of the apparatus.

I claim:

1. Apparatus for the display of information comprising:

(a) at least one endless draw member guided around at least two reversing pulleys;

(b) a motor driving said endless draw member;

(c) a plurality of outwardly protruding holders carried by said draw member and extending transversely of the longitudinal direction thereof;

(d) a plurality of laminae carried by each of said holders with a free end thereof extending beyond the holder;

(e) the length of each lamina being greater than the distance between adjacent holders in the extended zone of the draw member whereby an overlap zone of adjacent laminae is maintained in said extended zone;

(f) the radius of one reversing pulley, the length of the laminae, and the distance between the draw member and the connection of the laminae to each holder being so related that said overlap is eliminated when said laminae pass round the said one reversing pulley;

(g) means for determining the position of the free ends of the laminae situated near the end of the reversal of the draw member by said one reversing pulley;

(h) said means selectively directing said lamina to a position either in front of or behind the overlap region of an adjacent lamina;

(i) each lamina having a forward region and a rearward region differentiated visually from one another whereby a desired display can be set up by selective exposure of said regions.

2. Apparatus according to claim 1, in which the forward region of each lamina is coloured differently from the rear region to differentiate the two regions.

3. Apparatus as defined in claim 1, wherein said laminae are of soft-magnetic material and are initially stressed to lie in the direction towards the draw member, and said means for influencing the free ends of the laminae comprises a number of electromagnets corresponding to the number of laminae arranged on each of the holders.

4. Apparatus as defined in claim 1, wherein said laminae are of a resilient, nonmagnetic material and are initially stressed to lie away from the draw member and said means for influencing the free ends of the laminae comprises a number of air nozzles, corresponding to the number of laminae arranged on each of the holders, directed towards the draw member.

5. Apparatus as defined in claim 1, comprising a window behind which said draw member is moved, said window comprising a plurality of openings arranged in lines and columns, the number of openings arranged in each column being equal to the number of laminae arranged on each of the holders.

6. Apparatus as defined in claim 5, wherein said motor comprises a stepping motor, driving said reversing pulley at each step through an angle such that the draw member is moved through a distance greater than the distance between adjacent holders.

7. Apparatus as defined in claim 1, comprising two endless draw members, transverse ribs on the inner sides of said draw members and transversely of the direction of movement of the draw member, teeth on said reversing pulley meshing with said transverse ribs, the distance between adjacent ribs being equal to the distance between adjacent holders.

8. Apparatus as defined in claim 1 wherein the radius of said one reversing pulley is at most as great as the distance between the draw member and the connection of the laminae to each holder.

* * * * *